United States Patent [19]

Cash

[11] Patent Number: 4,759,002

[45] Date of Patent: Jul. 19, 1988

[54] CLOCK

[76] Inventor: Lew A. Cash, Box 11, Bloomingdale, Ohio 43910

[21] Appl. No.: 124,671

[22] Filed: Nov. 24, 1987

[51] Int. Cl.[4] ..... G04B 19/26

[52] U.S. Cl. ..... 368/15; 368/16; 368/17; 368/223; 368/221

[58] Field of Search ..... 368/15-27, 368/223, 228, 233, 234, 221

[56] References Cited

U.S. PATENT DOCUMENTS

| | | | |
|---|---|---|---|
| 309,306 | 12/1884 | Lindauer | 368/123 |
| 536,504 | 3/1895 | Arriaga | 368/21 |
| 723,489 | 3/1903 | Rosenbusch | 368/221 |
| 2,051,611 | 8/1936 | Liner | 58/125 |
| 2,130,873 | 9/1938 | Bourquin | 58/125 |
| 2,266,183 | 12/1941 | Fergusson | 58/125 |
| 2,287,679 | 6/1942 | Greenawalt | 58/125 |
| 2,852,908 | 9/1958 | Stern et al. | 58/57 |
| 3,439,492 | 4/1969 | Gravenson | 58/1 |
| 3,525,209 | 8/1970 | Ladas | 58/50 |
| 3,668,858 | 6/1972 | Hartwig | 58/2 |
| 3,890,777 | 6/1975 | Stanish | 58/50 R |
| 4,605,311 | 8/1986 | Loitz | 368/77 |
| 4,669,891 | 6/1987 | Rosevear | 368/21 |

OTHER PUBLICATIONS

Two Photographs of an Existing Grandfather Clock Disclosing a Supplementary Face Artistically Representing the Relative Daylight.

An Undated Advertisement for a Grandfather Clock having a Supplementary Face for the Graphic Representation of Daylight.

An Undated Magazine Advertisement for a Wristwatch having Hours and Minutes Displayed in a Semi-Circle Rather than a Conventional Circle.

*Primary Examiner*—Bernard Roskoski

*Attorney, Agent, or Firm*—Thomas R. Shaffer

[57] ABSTRACT

A clock having a housing which contains two internal disks and a motor for rotation of those disks on a shaft is disclosed. An hour disk is provided having a shaded region representing night and an unshaded region representing day. The hour disk is positioned to appear through a opening in the clock face. The face of the clock may have one or more openings to expose the minute and hour disks. One of the openings has a numerical representation of hours provided on the clock face there around. The clock is arranged so that the line separating the dark and light regions of the hour disk indicates the hour of day by pointing to a number on the face, and also graphically represents the amount of time from and to the previous and next sunrise or sunset.

7 Claims, 1 Drawing Sheet

Fig. 1.
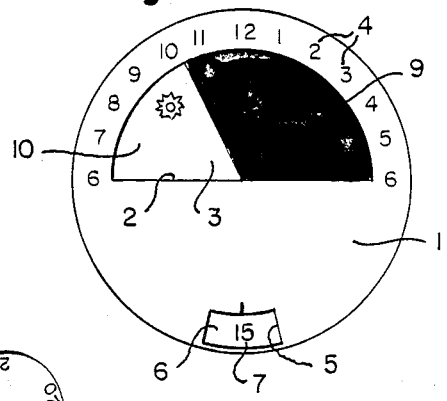
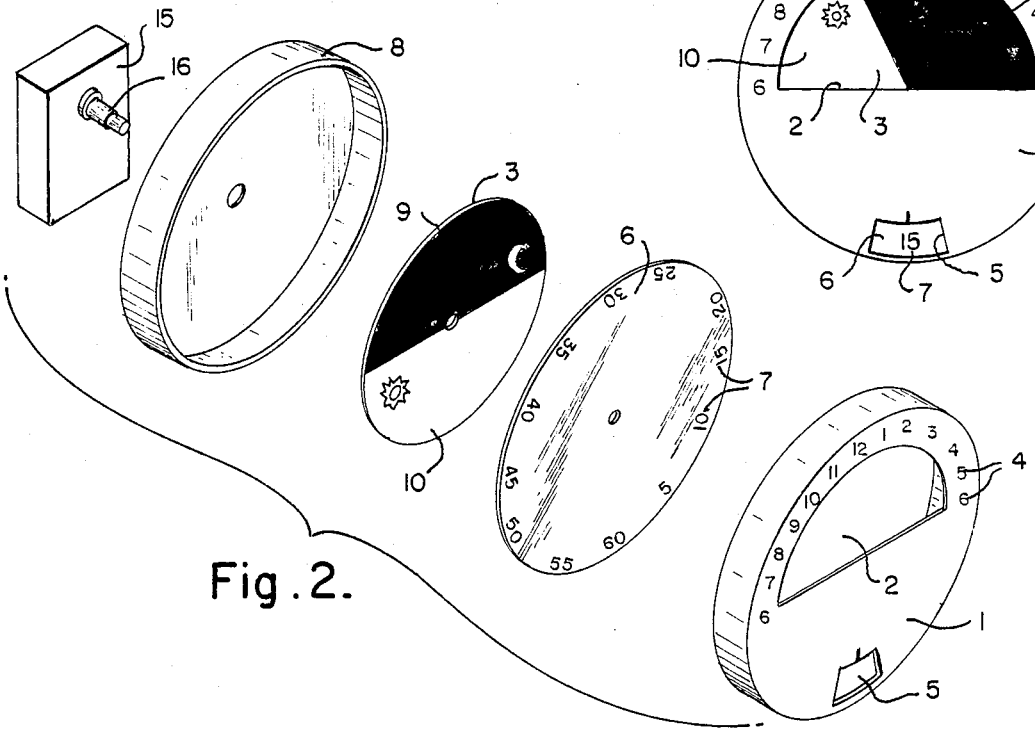
Fig. 2.
Fig. 3.
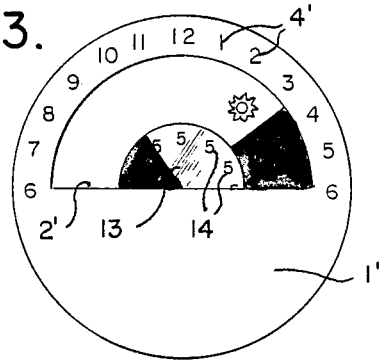
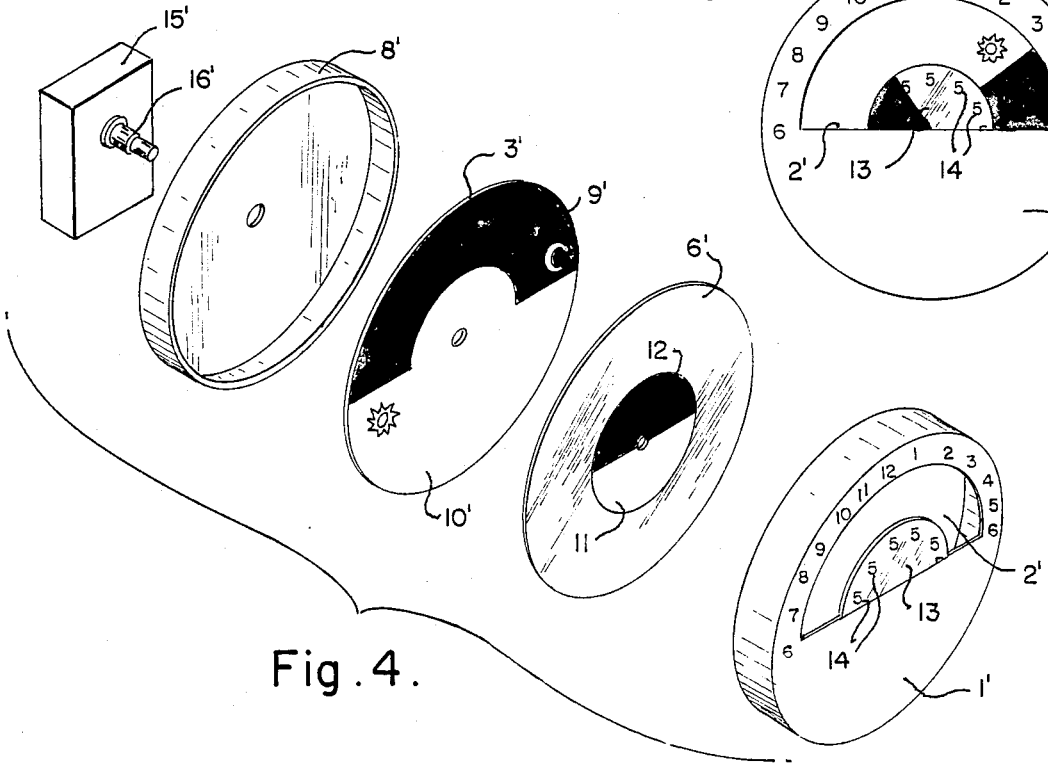
Fig. 4.

CLOCK

BACKGROUND OF THE INVENTION

1. Field of the Invention

The present invention relates to a clock. More specifically, it relates to a clock which presents a rotating hour disk having shaded and unshaded regions which indicates the hour of day and graphically represents the passage of daylight and darkness through an opening in the face.

2. Description of the Prior Art

Many different types of clocks are known in this art. Prior clocks, however, generally do not provide any direct intustive information to an observer as to whether it is daylight or night or any information regarding the approximate time to the next sunrise or sunset. Rather, most clocks rely on abstract symbols or indicator lights to provide an indication of a.m. or p.m. Twenty four hour clocks, for example, have been invented to improve on this problem, but they are unfamiliar in construction, and more than a quick glance is necessary to discern the time.

Prior to my invention, clocks that displayed the time in colors (rather than numbers) by hour were known. These clocks also require interpretation of abstract symbols to ascertain the time. Additionally, it was known to provide some type of graphic representation of auxillary disk shown through a separate window of sunrise, noon, sunset and midnight on a grandfather clock face. However, prior to the present invention, it was known known that a single rotating disk could be used to accurately indicate the present hour as well as provide an approximation in a quantitative manner of the passage of time from the previous and next sunrise and sunset.

SUMMARY OF THE INVENTION

The clock of the present invention includes a housing in which a motor is mounted for rotation of internal disks on a shaft. In a first embodiment of my invention, a transparent minute disk is provided which has numerical representations of minutes arranged about the perimeter of the disk. A hour disk having a shaded reigon representing night and an unshaded region representing day is also provided. In this embodiment, the minutes disk is larger than the shaded region of the hour disk so that the numbers may rotate around the outside of the shaded area.

In the first embodiment of my invention, the face of the clock has two openings, to expose the two inner dials. A first opening is provided to show the minutes as they rotate on the minute disk. A second opening is provided in the clock face having numbers representing hours arranged around an outer portion thereof. The second opening is preferrably generally hemispherical. The clock is arranged so that the line separating the dark and light regions of the hour disk indicates the hour of day by pointing at a number on the face, and also graphically represents the approximate time of the previous and next sunrise or sunset by rotation of the shaded regions of the hour disk. Thus, as the day goes on, more light colored area is exposed, and throughout the evening and night, more dark colored area is exposed.

A second embodiment of my invention utilizes a similar shaded/unshaded arrangement for the minute disk as well as the hour disk. The face, which has only one opening, is used to expose both disks. In the center of the opening, a transparent disk having numbers indicating the minutes of the hour is placed, and the minute disk is placed behind it. The minute disk is smaller than the hour disk in this embodiment, and is mounted so that the shaded portion shows through the transparent area with the minutes inscribed. Thus, the minute disk represents with the shaded portion the fractional passage of the hour.

These and other advantages and features of the present invention will be more fully understood on reference to the presently preferred embodiments thereof and to the appended drawings.

BRIEF DESCRIPTION OF THE DRAWINGS

FIG. 1 is a front view of a first embodiment of the clock face of the present invention.

FIG. 2 is an exploded isometric view of the clock of FIG. 1.

FIG. 3 is a front view of a second embodiment of the clock face of the present invention.

FIG. 4 is an exploded isometric view of the clock of FIG. 3.

Like parts in FIGS. 3 and 4 have the same reference numerals as FIGS. 1 and 2 with prime affixed thereto.

DESCRIPTION OF THE PREFERRED EMBODIMENTS

Referring to FIG. 1, a clock face 1 is provided having a hemispherical opening 2 which exposes hour disk 3. The hour disk is divided into shaded area 9 and unshaded area 10. Numerals 4 surround an outer portion of opening 2 to indicate the time marked by the division between areas 9 and 10. A second opening 5 exposes the minute disk 6, allowing the minutes of the hour to be read from the numerals 7 on the minute disk. As is readily apparent from FIG. 1, the clock indicates that it is 10:15 a.m., that sunrise occurred approximately four hours ago and that sunset will occur in approximately eight hours.

Referring to FIG. 2, the interior arrangement of the first embodiment is shown. Minute disk 6 with numerals 7 is placed immediately inside face 1. Behind minute disk 6 is hour disk 3, divided into shaded area 9 and unshaded area 10. Housing 8 surrounds the entire mechanism, and motor means 15 is mounted on the back of the housing. Shaft means 16 supports both disk 3 and disk 6. The clock mechanism which consists of motor means 15 and shaft means 16 may conveniently be a standard 24 hour clock mechanism which are commercially available.

A second embodiment is illustrated in FIGS. 3 and 4. A clock face 1' is provided having an opening 2' Numerals 4' surround the opening as in the previous embodiment. In this version of the invention, however, the hour disk 3' is obscured in the center by the shaded portion 12 and unshaded portion 11 of minute disk 6'. At least a portion of opening 2' is covered with a transparent section 13 of clock face 1, having numerals 14 inscribed thereon to allow the reading of the minutes of the hour by reference to the separating line between shaded portion 12 and unshaded portion 11 of minute disk 6'. The mechanism rotates the hour disk 3' once every 24 hours and minute disk 6, once every hour.

Referring to FIG. 4, the slight variation of the mechanism is apparent. Transparent area 13 on face 1' is positioned to allow the line beteen shaded portion 12 and unshaded portion 11 of minute disk 6' to indicate the minute of the hour using numerals 14. As in the previous embodiments, minute disk 6' and hour disk 3' are affixed to shaft 16, of motor means 15', which is supported and contained by housing 8'.

While I have described persent preferred embodiments of the invention, it is to be distinctly understood that the invention is not limited thereto but may be otherwise embodied and practiced within the scope of the following claims.

I claim:

1. A clock comprising:

a. a housing;

b. motor means having rotatable shaft means mounted within said housing;

c. a minute disk, mounted on said shaft means, for rotation within said housing, said disk having a rotation period of one hour;

d. an hour disk having a shaded region representing night and an unshaded region representing day, mounted on said shaft means, for rotation within said housing, said disk having a rotation period of 24 hours;

e. a clock face having at least one opening, arranged to expose at least a portion of said hour disk and said minute disk, said clock face further comprising numerical representations of hours positioned about one opening;

the clock adapted so that a line separating said shaded and unshaded regions of said hour disk indicates the hour of day represented on said face, and graphically approximates the amount of time from one to the previous and next sunrise or sunset, said clock also providing an indication of minutes of the hour.

2. A clock as in claim 1, wherein an opening is hemispherical.

3. A clock as in claim 1, wherein said minute disk is transparent and is larger than the hour disk, and said disks are arranged so that the numerals of said minute disk are visible beyond the shaded region of said hour disk.

4. A clock as in claim 1, wherein said hour disk is split on a diameter into light and shaded regions.

5. A clock as in claim 1, wherein said face has one opening for the exposure of the minute disk, and a separate opening for the exposure of the hour disk.

6. A clock as in claim 1, wherein said face has one opening for both the minute and the hour disks, said minute disk has a dark region and a light region, and having a smaller radius than said hour disk, is simultaneously exposed through the same opening as said hour disk.

7. A clock as in claim 6, wherein numerical representations of minutes are displayed on a transparent portion of said face, wherein a line between the light and dark portions of said minute disk indicate the minute of the hour, and graphically approximates passage of the hour.

* * * * *

UNITED STATES PATENT AND TRADEMARK OFFICE

CERTIFICATE OF CORRECTION

PATENT NO. : 4,759,002

DATED : July 19, 1988

INVENTOR(S) : Lew A. Cash

It is certified that error appears in the above-identified patent and that said Letters Patent is hereby corrected as shown below:

Column 2, line 53, after "2'" insert --.--.

Column 2, line 59, change "1," to --1',--.

Column 2, line 64, change "6," to --6--.

Column 3, line 3, change "16," to --16'--.

Column 1, line 31, delete "known".

Column 1, line 43, "reigon" should read --region--.

Column 2, line 67, change "beteen" to --between--.

Column 3, line 5, change "persent" to --present--.

Signed and Sealed this

Third Day of January, 1989

*Attest:*

*Attesting Officer*

DONALD J. QUIGG

*Commissioner of Patents and Trademarks*